United States Patent [19]

Berger et al.

[11] 4,366,227

[45] Dec. 28, 1982

[54] DIFFUSION TRANSFER FILM UNIT

[75] Inventors: Michael Berger, Chestnut Hill; John J. Magenheimer, Wellesley, both of Mass.

[73] Assignee: Polaroid Corporation, Cambridge, Mass.

[21] Appl. No.: 277,921

[22] Filed: Jun. 26, 1981

[51] Int. Cl.[3] ..... G03C 1/40; G03C 5/54; G03C 1/90; G03C 1/48

[52] U.S. Cl. ..... 430/215; 430/227; 430/228; 430/244; 430/245; 430/248; 430/256; 430/263

[58] Field of Search ..... 430/212, 215, 227, 244, 430/245, 228, 236, 248, 256, 262, 263

[56] References Cited

U.S. PATENT DOCUMENTS

| | | | |
|---|---|---|---|
| 2,492,952 | 1/1950 | Ball et al. | 430/261 |
| 2,615,807 | 10/1952 | Umberger | 430/261 |
| 2,983,606 | 5/1961 | Rogers | 430/224 |
| 3,552,971 | 1/1971 | Takenaka et al. | 430/263 |
| 3,573,907 | 4/1971 | Verelst et al. | 430/258 |
| 3,674,482 | 7/1972 | Haberlin | 430/728 |
| 3,884,693 | 5/1974 | Bauer et al. | 430/263 |
| 3,884,789 | 10/1974 | Bates et al. | 430/261 |
| 4,056,392 | 11/1977 | Scott | 430/228 |

*Primary Examiner*—Richard L. Schilling
*Attorney, Agent, or Firm*—Philip G. Kiely

[57] ABSTRACT

A diffusion transfer film unit comprising a support, a photosensitive silver halide emulsion layer, an image-receiving layer and, intermediate said silver halide emulsion layer and said image-receiving layer, a release layer which comprises a water-soluble polymer and a styrenated acid functional acrylic resin. In a preferred embodiment, the film unit is a silver diffusion transfer film unit.

30 Claims, No Drawings

DIFFUSION TRANSFER FILM UNIT

BACKGROUND OF THE INVENTION

Procedures for preparing photographic images in silver by diffusion transfer principles are well known in the art. For the formation of positive silver images, a latent image contained in an exposed photosensitive silver halide emulsion is developed and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion, and, substantially contemporaneous therewith, forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image. Procedures of this description are disclosed, for example, in U.S. Pat. No. 2,543,181 issued to Edwin H. Land. See also Edwin H. Land, *One Step Photography,* Photographic Journal, Section A, pgs. 7–15, January 1950.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with the positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615,428; 3,615,429; and 3,894,871.

U.S. Pat. No. 3,674,482 issued July 4, 1972, is directed to a silver diffusion transfer film unit which comprises a support carrying on one surface, in order, a layer containing a silver precipitating nuclei, an inert non-nuclei-containing protective layer and a layer containing a photosensitive silver halide emulsion. The purpose of the non-nuclei-containing protective layer is to provide a layer over the transferred silver image after the emulsion layer has been removed subsequent to processing, which protective layer will then be the outermost layer. The material for the protective layer is one which is readily permeable to the processing composition and which will not provide sites for the nucleation of the silver forming the transferred image. A particularly preferred material employed as a protective layer comprises chitosan (deacetylated chitin).

U.S. Pat. No. 4,056,392, issued Nov. 1, 1977 is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer, an increase in $D_{max}$ is achieved with substantially no adverse effect on $D_{min}$ compared to a protective layer composed of chitosan alone.

It is well known in the art to employ layers in film units adapted to allow separation of one portion of a film unit from another subsequent to processing. Such layers are referred to as stripping layers or release layers. For example, in U.S. Pat. No. 3,844,789, it is stated (Col. 4, lines 43–51):

> "The stripping layer 3 may be prepared with any of the conventional materials promulgated in the art for such purposes and usually comprises a film forming organic colloid, polymeric material, etc., soluble at neutral and/or alkaline pH with typical representatives including, for example, and without necessary limitation gelatin, PVP (polyvinyl pyrrolidone), PVA (polyvinyl alcohol), carboxymethyl cellulose, gum arabic and the like."

U.S. Pat. No. 2,615,807 is directed to a method of insolubilizing a stripping layer by treating a polyvinyl acetal with an aqueous solution containing a water-soluble cationic surface active wetting agent and then resolubilizing the layer for stripping by treating with an aqueous solution containing an anionic surface active wetting agent.

Stripping layers are disclosed in U.S. Pat. No. 2,492,952 as follows: (Col. 3, lines 6–20):

> "The stripping layers of the elements may be composed of various materials which are softened or dissolved by water. Thus, they may be composed of any water-soluble colloid (viz. which has a marked solubility in water at 20° C.) of natural or synthetic type. Suitable colloids include water-soluble cellulose derivatives, e.g., low substituted cellulose ethers, such as methyl cellulose, ethyl cellulose, and benzyl cellulose; cellulose esters having solubilizing acid salt groups, e.g., sodium, potassium, and ammonium salts of cellulose acid phthalate; cellulose ether acids, e.g., sodium cellulose glycollate, casein gelatin mixtures; water-soluble synthetic resins, e.g., polyvinyl alcohol and esters."

The above-mentioned U.S. Pat. No. 3,674,482 also discloses the use of stripping layers and mentions as suitable materials for said stripping layers cellulose acetate hydrogen phthalate or acid functional waxes such as methyl acrylate/acrylic acid copolymer.

SUMMARY OF THE INVENTION

The present invention is directed to a diffusion transfer film unit comprising a support, a photosensitive silver halide emulsion layer, an image-receiving layer and, intermediate said silver halide emulsion layer and said image-receiving layer, a release layer which comprises a water-soluble polymer and a styrenated acid functional acrylic resin. In a preferred embodiment the film unit is a silver diffusion transfer film unit.

DETAILED DESCRIPTION OF THE INVENTION

For convenience, in describing the present invention the term "release layer" will be employed to identify a layer in a film unit adapted to lose its adhesive capability during processing to permit detachment of certain layers of the film unit at the interface of said release layer. The selection of this term instead of "stripping layer" has been made to avoid confusion with the term "stripping sheet" which is intended to refer to a structure employed to contact the processing composition-wetted film unit to assist in detaching the desired layers of the film unit at the interface between the release layer and the other layers of the film unit.

In film units of the type described in U.S. Pat. No. 3,674,482, for example, it is essential that the release layer initially maintain a good bond (dry peel strength) between the adjacent layers and then, during the stripping operation, cleanly release from that portion of the film containing the positive silver image. Since the film unit is a transparency film unit, the retention of release layer material on the protective layer diminishes the quality of the projected image both visually and in terms of image stability. Thus, the prior art materials, referred to above, which are water and/or alkali soluble or softenable have not been found to function reliably with respect to the above-mentioned criteria. For example, hydroxyethyl cellulose, described above as a release layer requires a relatively large coverage to provide the dry peel strength desired, but, at such a coverage, fails to strip cleanly subsequent to processing.

It has now been found that by employing, as a release layer, a mixture of a water-soluble polymer and a styrenated acid functional acrylic resin, good dry peel strength or adhesion between the layers is obtained as well as clean release subsequent to processing with improved sensitometry.

Preferably, the release layer is predominantly water-soluble polymer. In a preferred embodiment, the ratio of water-soluble polymer to styrenated acid functional acrylic resin is at least about 6 to 1, weight basis. It should be understood that the particular thickness of the release layer may be varied over a relatively wide range depending upon the degree of dry adhesion and release characteristics desired.

The styrenated acid functional acrylic resin possesses an ester easily cleaved by the alkaline processing composition to form a salt but also possesses sufficient acid function to provide solubility in weak base, e.g., less than pH 10, to permit the ready passage of image forming material and processing reagents therethrough.

As examples of suitable water-soluble polymers mention may be made of hydroxyethyl cellulose, sodium carboxymethyl cellulose, and gelatin.

The release layers of the present invention are useful in a variety of film structures wherever it is desired to separate the layer containing the diffusion transfer image and the silver halide emulsion layer. Thus, the release layer can be employed between a dyeable image-receiving layer and a silver halide emulsion layer, in the case of a diffusion transfer film unit employing dye image forming material, as disclosed, for example, in U.S. Pat. No. 2,983,606, particularly FIG. 8.

The release layers are also advantageously employed in silver diffusion transfer film units between the image-receiving layer which contains silver precipitating nuclei and the silver halide emulsion layers.

In a preferred embodiment, the film unit is a silver diffusion transfer film unit, which comprises, in order, a transparent support, a layer comprising silver precipitating nuclei, a protective layer, the release layer and a photosensitive silver halide emulsion layer.

In a particularly preferred embodiment, the film unit is an additive color diffusion transfer film unit, wherein the support would carry an additive color screen.

The release layers of the present invention are particularly suitable for use with the protective layers disclosed in copending application of Michael Berger, Charles H. Byers and John J. Magenheimer, Ser. No. 277,926 and copending application of Michael Berger, Ser. No. 277,945, both filed concurrently herewith.

The following nonlimiting example illustrates the novel film units of the present invention.

EXAMPLE A

A film unit was prepared comprising a transparent polyester film base and carrying on one surface an additive color screen of approximately 1500 lines each per inch of red, blue and green filter screen elements in repetitive side by side relationship; a 2.3μ polyvinylidine chloride/polyvinyl formal layer; a nucleating layer comprising palladium nuclei at a coverage of about 0.23 mg/ft$^2$ of palladium (prepared according to the procedure of copending application Ser. No. 80,691 filed Oct. 1, 1979, now U.S. Pat. No. 4,281,056, issued July 28, 1981), 0.23 mg/ft$^2$ of gelatin and 10 mg/ft$^2$ of hydroxyethyl cellulose; a protective layer as described below; a release layer as described below; a panchromatically sensitized gelatino silver iodobromide emulsion; a top coat comprising gelatin, antihalation dyes and about 15 mg/ft$^2$ of 3μ silica particles.

Film units described above were prepared employing the protective layers and silver coverages designated below. Dry peel strengths were obtained on a tensile tester (Model 1122, Instron Corp., Canton, MA). The film units were exposed at 4 mcs to a multi-color target and processed with mechanical rollers at a 0.0016 in. gap disposing the processing composition indicated below between the top coat and a stripping sheet comprising a polyester support carrying a layer comprising 250 mg/ft$^2$ gelatin and 25 mg/ft$^2$ zinc acetate. The film was held in the dark for one minute and then the stripping sheet was removed with the top coat and emulsion layers.

| Processing Composition | Weight % |
|---|---|
| Sodium hydroxide | 8.54 |
| Hydroxyethyl cellulose (sold by Hercules, Inc., Wilmington, Delaware under the tradename Natrosol 250 HH) | 1.36 |
| Tetramethyl reductic acid | 5.83 |
| Potassium bromide | 0.68 |
| Sodium sulfite | 0.90 |
| 2-methylthiomethyl-4,6-dihydroxypyrimidine | 6.22 |
| 4-aminopyrazolo-[3,4d]-pyrimidine | 0.02 |
| N—benzyl-α-picolinium bromide (50% solution) | 3.11 |
| Water | 73.5 |

In Examples 1–4 the protective layer comprises 1.1 mg/ft$^2$ copper acetate, 3.25 mg/ft$^2$ chitosan and 0.65 mg/ft$^2$ glycerol. In Example 5 there was no protective layer.

TABLE 1

| | Release Layer | | | |
|---|---|---|---|---|
| Example | Water Soluble Polymer | Styrenated Acid Functional Acrylic Resin | Dry Peel Strength g/in. | Stripping Performance During Processing |
| 1 | Hydroxyethyl cellulose 12 mg/ft$^2$ | 1 mg/ft$^2$ | 83.5 | good |
| 2 | Hydroxyethyl cellulose 6 mg/ft$^2$ | 1 mg/ft$^2$ | 73 | good |
| 3 | Hydroxyethyl cellulose | 2 mg/ft$^2$ | 102.5 | good |

TABLE 1-continued

| Example | Water Soluble Polymer | Release Layer: Styrenated Acid Functional Acrylic Resin | Dry Peel Strength g/in. | Stripping Performance During Processing |
|---|---|---|---|---|
| | 6 mg/ft$^2$ | | | |
| 4 | Carboxymethyl cellulose 6 mg/ft$^2$ | 2 mg/ft$^2$ | 80 | fair–poor |
| 5 | Hydroxyethyl cellulose 12 mg/ft$^2$ | 1 mg/ft$^2$ | 57 | very good |

The hydroxyethyl cellulose employed in the above examples was NATROSOL 250L, sold by Hercules, Inc., Wilmington, Del. The styrenated acid functional acrylic resin was a dispersion of a tripolymer (about 1:1:1) of styrene, acrylic (or methacrylic) acid and methylmethacrylate (or methylacrylate) sold by Johnson Wax Co., Racine, Wis. under the trade name BRIGHT PLATE NO. 27.

The support employed in the present invention is not critical. The support or film base employed may comprise any of the various types of rigid or flexible supports. For example, glass, polymeric films of both the synthetic type and those derived from natural occuring products, including paper, may be employed. If a transparency is desired, a transparent support is employed; if a reflection print is desired, an opaque support is employed. Especially suitable materials comprise flexible transparent synthetic polymers such as polymethacrylic acid; methyl and ethyl esters; vinyl chloride polymers, polyvinyl acetals; polyamides such as nylon; polyesters such as the polymeric films derived from ethylene glycol terephthalic acid; polymeric cellulose derivatives such as cellulose acetate propionate; polycarbonates; polystyrenes and the like.

The additive color screen employed in the present invention may be formed by techniques well known in the art. For example, by sequentially printing the requisite filter patterns by photomechanical methods. An additive color screen comprises an array of sets of colored areas or filter elements usually from 2–4 different colors, each of said sets of colored areas being capable of transmitting visible light within a predetermined wavelength range. In the most common situations, the additive color screen is trichromatic and each set of color filter elements transmits light within one of the so called primary wavelength ranges, i.e., red, green, or blue. The additive color screen may be composed of minute dyed particles such as starch grains or hardened gelatin particles intermixed and interspersed in a regular or random arrangement to provide a mosaic. A regular mosaic of this type may be made by an alternating embossing and doctoring technique described in U.S. Pat. No. 3,019,124. Another method of forming a suitable color screen comprises multiline extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example may be selected from the alkali metal thiosulfates, particularly sodium or potassium thiosulfates, or the silver halide solvent may be a cyclic imide, such as uracil, in combination with a nitrogenous base as taught in U.S. Pat. No. 3,857,274 issued Oct. 21, 1958 to Edwin H. Land or pseudouracils, such as the 4,6-dihydroxypyrimidines as taught in U.S. Pat. No. 4,126,459, issued Nov. 21, 1978. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The requisite alkalinity, e.g., a pH of 12–14, is preferably imparted to the processing composition, by employing, for example, sodium, potassium and/or lithium hydroxide.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha,\beta$-enediols as disclosed in U.S. Pat. No. 3,730,716 issued to Edwin H. Land, Stanley M. Bloom and Leonard C. Farney on May 1, 1973.

What is claimed is:

1. A diffusion transfer film unit comprising a support, a photosensitive silver halide emulsion layer, an image-receiving layer and, intermediate said silver halide emulsion layer and said image-receiving layer, a release layer comprising a water-soluble polymer and a styrenated acid functional acrylic resin possessing an ester cleavable by alkaline processing composition to form a salt and possessing sufficient acid function to provide solubility in a weak base of pH less than 10.

2. The film unit of claim 1 wherein said image-receiving layer is a dyeable image-receiving layer and said film unit includes a dye-image-forming material.

3. The film unit of claim 1 wherein said film unit is a silver diffusion transfer film unit and said image-receiving layer contains silver precipitating nuclei.

4. A silver diffusion transfer film unit which comprises a support carrying, in order, a layer comprising silver precipitating nuclei; a protective layer; a release layer comprising a water-soluble polymer and a styrenated acid functional acrylic resin possessing an ester cleavable by alkaline processing composition to form a salt and possessing sufficient acid function to provide solubility in a weak base of pH less than 10; and a photosensitive silver halide emulsion layer.

5. The film unit of claim 4 wherein said support is transparent.

6. The film unit of claim 4 wherein said support is opaque.

7. The film unit of claim 5 which includes an additive color screen.

8. The film unit of claim 4 wherein said water-soluble polymer is hydroxethyl cellulose.

9. The film unit of claim 4 wherein said water-soluble polymer is carboxymethyl cellulose.

10. The film unit of claim 4 wherein said styrenated acid functional acrylic resin is a tripolymer (1:1:1) of styrene, acrylic acid and methylacrylate.

11. The film unit of claim 4 wherein said release layer is predominantly water-soluble polymer.

12. The film unit of claim 11 wherein the ratio of said water-soluble polymer to said styrenated acid functional acrylic resin is at least 6 to 1.

13. The film unit of claim 12 wherein said ratio is about 12 to 1.

14. The film unit of claim 4 wherein said protective layer comprises copper acetate, chitosan and glycerol.

15. The film unit of claim 4 wherein said protective layer is copper acetate, chitosan and gelatin.

16. The film unit of claim 4 which includes an antihalation material.

17. A photographic process which comprises the steps of:

(a) exposing a film unit which comprises a support carrying, in order, a layer comprising silver precipitating nuclei; a protective layer; a release layer comprising a water-soluble polymer and a styrenated acid functional acrylic resin possessing an ester cleavable by alkaline processing composition to form a salt and possessing sufficient acid function to provide solubility in a weak base of pH less than 10 and a photosensitive silver halide emulsion layer;

(b) contacting said exposed film unit with a liquid processing composition; and (c) detaching said photosensitive silver halide emulsion layer from the remainder of the film unit.

18. The process of claim 17 wherein said support is transparent.

19. The process of claim 17 wherein said support is opaque.

20. The process of claim 18 wherein said film unit is an additive diffusion transfer film unit.

21. The process of claim 20 wherein said film unit includes an antihalation material.

22. The process of claim 17 wherein said water-soluble polymer is hydroxyethyl cellulose.

23. The process of claim 17 wherein said water-soluble polymer is carboxymethyl cellulose.

24. The process of claim 17 wherein said styrenated acid functional acrylic resin is a tripolymer (1:1:1) of styrene, acrylic acid and methylacrylate.

25. The process of claim 17 wherein said release layer is predominantly water-soluble polymer.

26. The process of claim 17 wherein the ratio of said water-soluble polymer to said styrenated acid functional acrylic resin is at least 6 to 1.

27. The process of claim 26 wherein said ratio is about 12 to 1.

28. The process of claim 17 wherein said protective layer comprises copper acetate, chitosan and glycerol.

29. The process of claim 17 wherein said protective layer comprises copper acetate, chitosan and gelatin.

30. The process of claim 17 wherein said silver halide emulsion layer is detached by contact with a stripping sheet.

* * * * *